US006682138B2

(12) United States Patent
Adams et al.

(10) Patent No.: US 6,682,138 B2
(45) Date of Patent: Jan. 27, 2004

(54) RESIN MOLDED FOLDING CHAIR

(75) Inventors: William E. Adams, Portersville, PA (US); Matthew W. Goodworth, Pittsburgh, PA (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 10/113,661

(22) Filed: Mar. 29, 2002

(65) Prior Publication Data

US 2003/0184132 A1 Oct. 2, 2003

(51) Int. Cl.[7] ..... A47C 4/00
(52) U.S. Cl. ..... 297/56; 297/57
(58) Field of Search ..... 297/16.1, 55, 56, 297/59, 57

(56) References Cited

U.S. PATENT DOCUMENTS

| | | | | | |
|---|---|---|---|---|---|
| 241,533 | A | | 5/1881 | Flint | |
| 274,730 | A | | 3/1883 | Decker | |
| 326,564 | A | * | 9/1885 | Hopkins | 297/59 |
| 332,342 | A | | 12/1885 | Horn et al. | |
| 577,106 | A | | 2/1897 | Kidder | |
| 688,468 | A | | 12/1901 | Ihde | |
| 882,010 | A | | 3/1908 | Maxwell | |
| 1,716,526 | A | * | 6/1929 | Mason | 297/59 |
| 1,876,549 | A | * | 9/1932 | Bales | 297/41 |
| 1,975,622 | A | * | 10/1934 | Schermerhorn | 297/452.55 |
| 2,781,080 | A | * | 2/1957 | Pavlicek | 297/56 |
| 2,873,793 | A | | 2/1959 | Garcia | |
| 3,574,400 | A | * | 4/1971 | Day | 297/452.14 |
| 3,989,212 | A | * | 11/1976 | Jennings | 297/451.11 |
| 5,681,078 | A | * | 10/1997 | Chen | 297/58 |
| 6,099,073 | A | | 8/2000 | Bruschi | |

FOREIGN PATENT DOCUMENTS

| | | |
|---|---|---|
| FR | 579800 | 10/1924 |

* cited by examiner

*Primary Examiner*—Peter R. Brown
(74) *Attorney, Agent, or Firm*—Buchanan Ingersoll, P.C.

(57) ABSTRACT

A molded resin folding chair having a pair of uprights generally parallel to and spaced apart from each other being connected by at least one cross piece forming a backrest. At least a portion of each upright has a generally C-shaped channel. A seat has a rear portion and opposite sides thereof provided with a tab that is slidably engaged in the C-shaped channel of a respective upright. A pair of struts each have an upper end rotatably attached to the seat and a medial region rotatably attached to respective uprights. The folding chair is folded by sliding the rear of the seat upwards, causing the front portion to move downwards, via the tabs sliding in the C-shaped channels. The struts rotate about the rotatable attachments to the seat and uprights, such that the uprights, struts and the seat fold as flat as possible.

11 Claims, 5 Drawing Sheets

RESIN MOLDED FOLDING CHAIR

FIELD OF INVENTION

This invention relates generally to folding chairs, and more particularly, to a molded resin folding chair.

BACKGROUND

Folding chairs are well known in the art, but are most commonly made from metal or wood, and are thus more costly to manufacture. A folding chair typically is constructed of a pair of uprights which are generally parallel and spaced apart from each other, being joined together by one or more cross pieces, which also form the seat back. Other parts of the folding chair include a pair of struts, also generally parallel, spaced apart from each other, and joined by one or more cross pieces. Upper ends of the struts are engaged with the seat whereas the lower ends of the struts support the folding chair in conjunction with the lower ends of the uprights. At points generally intermediate the upper and lower ends, the struts are rotatably attached to the uprights. A back region of the seat is engaged with the uprights at points intermediate the backrest and the lower ends of the upright. Depending on the configuration of the particular folding chair, the seat may be slidably engaged with the uprights to facilitate folding the chair into a configuration wherein the seat, struts, and uprights assume a somewhat parallel relationship with each other so the that chair will fold as flat as possible.

With the advances in the plastic molding industry in recent times, it has become possible to mold many items from resins, such as polypropylene, at a much lower cost than manufacturing the item from metal or wood. However, such resins are generally not as rigid as metal or wood. Wood, for example, is about 10 times more rigid than polypropylene. Rigidity is understandably important in the manufacture of folding chairs since the chair must support the weight of a person resting on the seat.

Making a folding chair from resin can be also more difficult because of problems particularly associated with resin molding processes. Since molded resin is generally less rigid than metal or wood, the frame members of the chair must be configured for structural rigidity. However, molding shapes which have good structural rigidity can present manufacturing problems. For example, one known prior art plastic folding chair utilizes tubular legs having a channel formed adjacent the tubular portion. Although this structure has good structural rigidity, there can be significant problems associated with the molding of tubular legs. In particular, for example, a hollow tubular chair leg can require the use of a core member about which the tube is molded. After molding the tubular part this core member must be removed, which requires a relatively long "prong" member to perform the removal. A prong member of such length can create significant maintenance problems. Another problem with molding tubular parts is that shrinkage and warping commonly occur after the tubular part is removed from the mold and begins cooling. Typically, this results because some parts or sides of the tube will cool faster than others, causing the sides of the tube to shrink at different rates. This results in warping of the tube. These and other problems must be dealt with when molding chairs from resin, including polypropylene which is commonly used because of its low cost.

Accordingly, it is desirable to provide a resin molded folding chair which is strong, lightweight, and avoids manufacturing problems such as frequent mold maintenance, shrinkage, and warping.

SUMMARY OF THE INVENTION

A molded resin folding chair is provided having uprights which are molded with a generally C-shaped channel, in which tab portions on either side of the seat of the folding chair are slidably captured. The uprights are joined by one or more cross pieces positioned at or near the bottom and at or near the top, wherein one or more top cross pieces form a backrest for the folding chair. The chair further has struts which, at an upper end, are rotatably attached to the base or sides of the seat and, at points intermediate the upper and lower ends, are also rotatably attached to the uprights. The struts can also include a cross piece at or near the lower ends thereof. The chair folds by, for example, lifting the back of the seat upwards, causing the tabs on either side of the seat to slide upwards in the C-shaped channel in each of the uprights. In this manner, the front of the seat rotates downwards and the struts rotate inward. The struts rotate about the attachments to both the uprights and the seat, rotating into a position where the struts are as much as possible parallel to the uprights when the chair is folded. The struts can be similarly formed in a simple C-shape. For increased strength, the uprights, and the struts, can further be formed with transverse ribs positioned in, and at spaced apart locations along, the C-shaped channels. In the pertinent locations along the uprights, the transverse ribs can be sized so as not to interfere with the sliding engagement of the seat tabs in the C-shaped channels. Additionally, the uprights preferably have a molded-in curvature. For example, the upper part of the uprights can be formed at an angle to the lower part, with the apex located generally at the point where the seat attaches. This can be done not only to provide a backrest which is more perpendicular when the folding chair is unfolded for use, but also because the built-in curvature can reduce problems associated with shrinkage and warping. Furthermore, the uprights can be tapered from the apex towards the backrest. The curved uprights and position of the seat, backrest and struts enable the chair to stand alone when the chair is in a folded position. The curved shape also provides comfort to the user and strength to the chair.

Other details, objects, and advantages of the invention will become apparent from the following detailed description and the accompanying drawings figures of certain embodiments thereof.

BRIEF DESCRIPTION OF THE DRAWING FIGURES

A more complete understanding of the invention can be obtained by considering the following detailed description in conjunction with the accompanying drawings, in which.

DETAILED DESCRIPTION OF CERTAIN EMBODIMENTS

Figure 1:
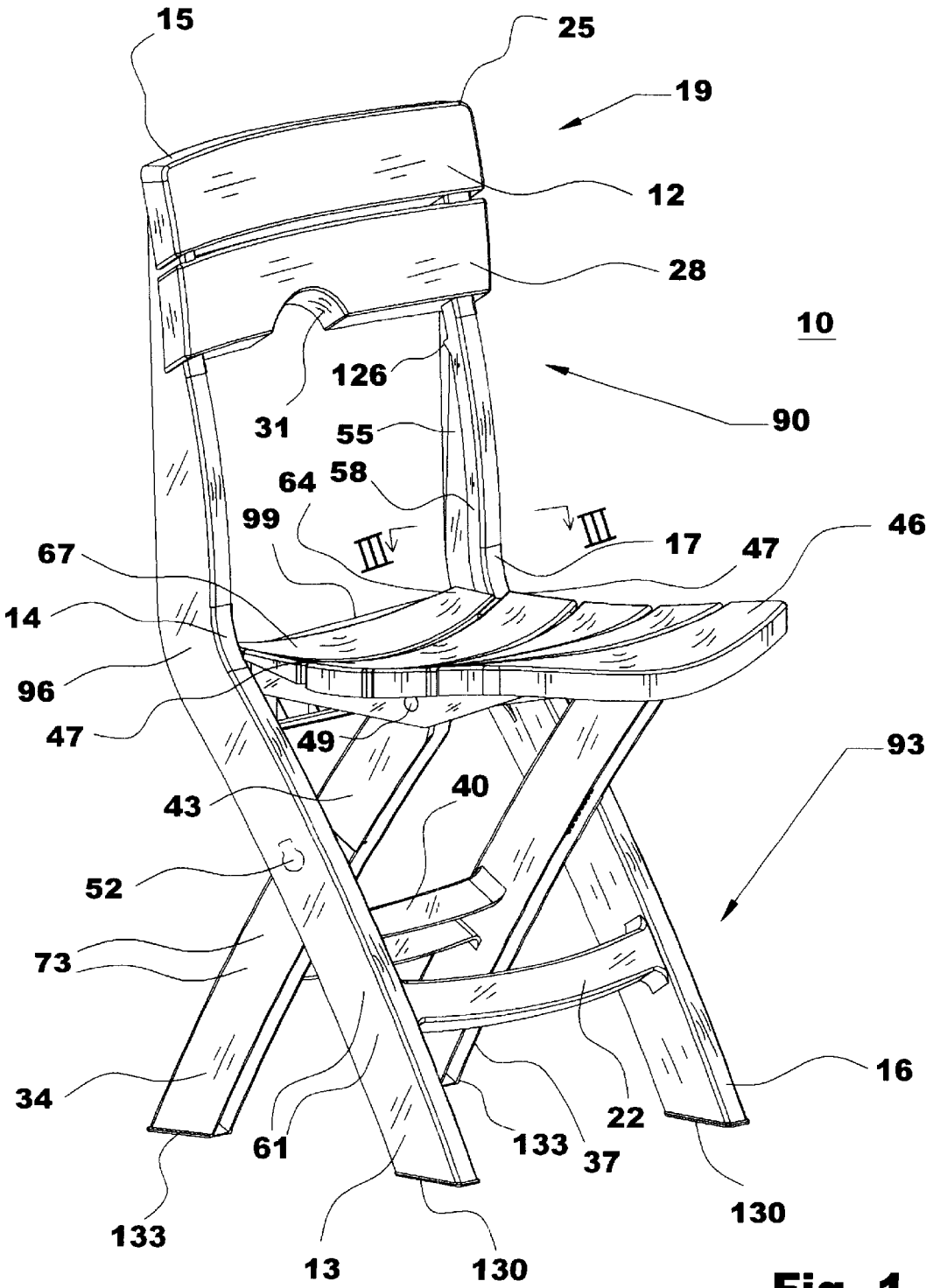
FIG. 1 is a perspective view of a presently preferred embodiment of a folding chair in an open position.
Figure 2:
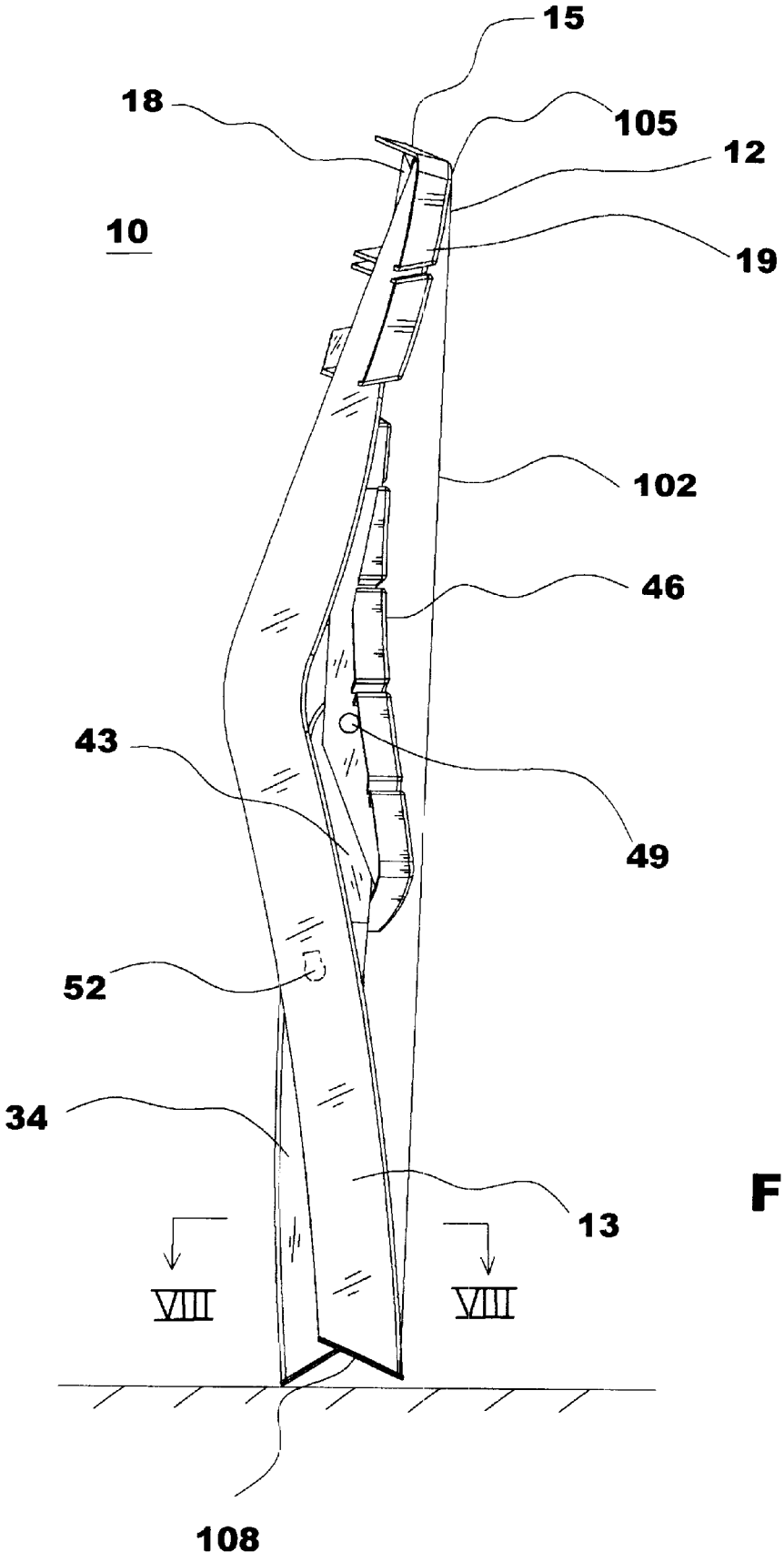
FIG. 2 is a side view of the folding chair in FIG. 1 shown in a folded, standing position.

Referring now to the drawing figures wherein like reference numbers refer to similar parts throughout the several views, a presently preferred folding chair 10 molded from resin is shown in FIGS. 1 and 2 having a pair of uprights 13, 16, generally parallel to each other and spaced apart, a backrest 19 and lower cross piece 22 connecting the uprights 13, 16 together. The backrest 19 is shown being a pair of cross pieces 25, 28 with the lower one 28 having a cut out portion 31 at generally the middle thereof. We prefer to provide gussets 18 in the top cross piece 25 between the top 15 and front portion 12 of the top cross piece. These gussets strengthen the top edge of cross piece 25 reducing the likelihood of breakage should something hit the top of the cross piece, particularly during storage or shipment. A pair of struts 34, 37, also generally parallel, spaced apart, and connected by a cross piece 40 have a top end 43 (only one side visible) which is rotatably attached to the bottom of the seat 46, such as by a pin 49. Each strut 34, 37 is also rotatably attached, such as by a pin 52, to the uprights 13, 16 at about the middle of each strut 34, 37. The exact location of the pin 52 is dependent on the length of the strut 34 and the uprights 13 and the location of the pinned attachment of the top end 43 of the strut 34 to the seat 46. The location of the pins 49, 52 also depend on the requisite geometry for the chair 10, both for use as a comfortable chair to sit on and in order to fold as flat as possible when it is not being used. Although pin 52 could be variously configured we prefer the shape shown in FIG. 1. Having a single male prong extending from a round body ensures that the legs will be assembled only one way and the correspondingly shaped opening is less likely to cause cracking than a rectangular slot.

Figure 3:
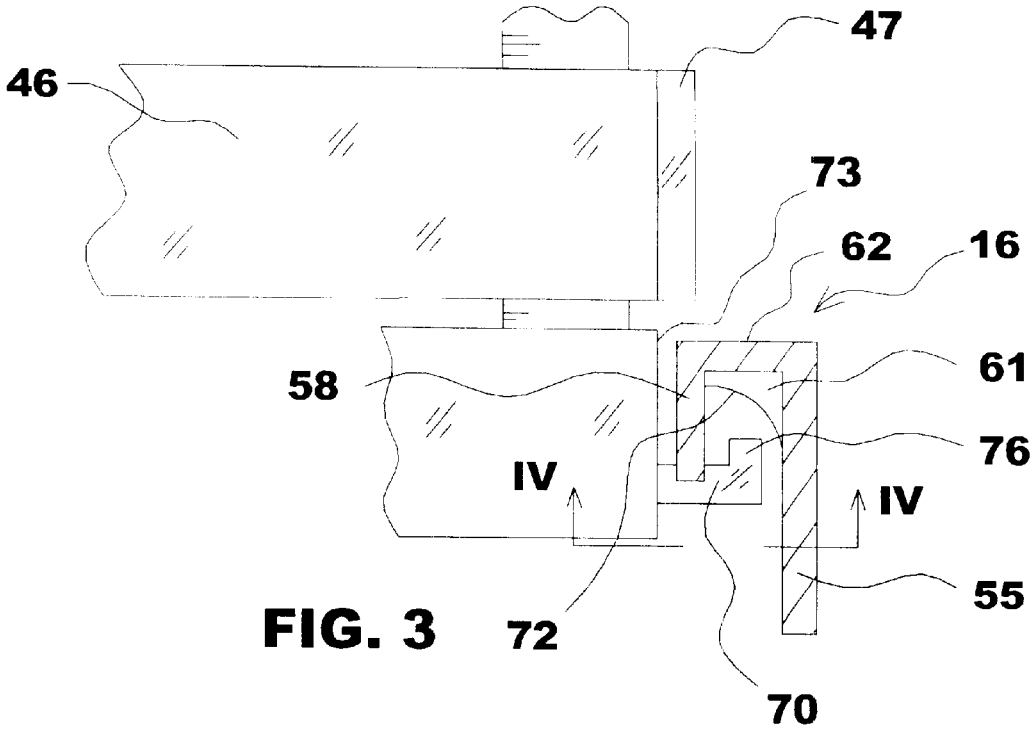
FIG. 3 is a cross section view taken along line III—III in FIG. 1.
Figure 4:
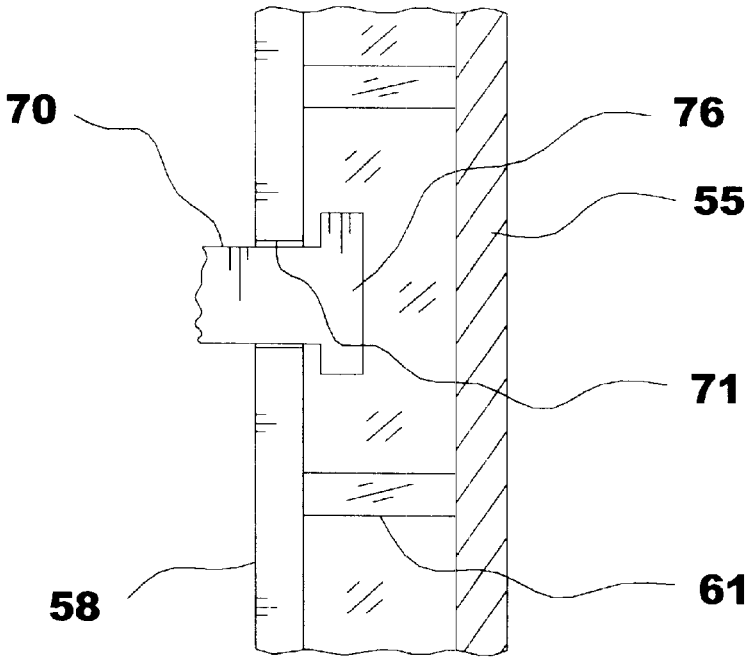
FIG. 4 is a cross section view taken along line IV—IV in FIG. 3.

Each upright 13, 16 is formed in a generally C-shaped channel configuration as shown in FIGS. 3 and 4. The outer leg 55 of the C-shaped channel is formed longer than the inner leg 58. Transverse ribs 61 can be formed in the base 62 of the C-shaped channel to increase the stiffness of the uprights 13, 16. Each corner 64, 67 of the seat is slidably engaged in the C-shaped channel by a tab 70 provided adjacent the uprights 13, 16. Each tab 70 is a generally L-shaped protrusion which, in conjunction with each side of the seat 46 from which the tab 70 extends, forms a second generally C-shaped channel. The outer leg 76 of each tab 70 is slidably engaged in the C-shaped channel formed in each upright 13, 16. The sliding engagement between the seat 46, tab 70 and the uprights 13, 16 permits the seat 46 to be folded as flat as possible against the uprights 13, 16. The seat tab 70 is restrained from falling out the open end of the C-shaped channel by extending the sides 47 of the seat 46 out over the front surfaces 14, 17 of the uprights 13, 16. The sides 47 of the seat 46 loosely abut the front surfaces 14, 17 of the uprights the through the entire range of movement of the seat as tab 70 travels in the C-shaped channel. This arrangement maintains the seat tab 70 securely engaged in the C-shaped channel. Additionally, a notch 71 can be provided in the inner leg 58 of the C-shaped channel, in which the seat tab 70 can be received when the chair 10 is in a completely unfolded position. The notch 71 can help retain the seat tab 70, and thus the seat 46, in a more stabilized unfolded position until the back of the seat 46 is intentionally manipulated to return the chair 10 to a folded position.

The transverse ribs 61 formed in the base 62 of the C-shaped channel in the uprights 13, 16, particularly in the region wherein the tabs 70 on each side of the seat 40 are slidably engaged, can be of minimal height such that the transverse ribs 61 do not interfere with the sliding action of the seat tabs 70 in the C-shaped channel when the chair 10 is folded or unfolded. Furthermore, the transverse ribs 61 can be formed with an arcuate edge 72 which extends further towards the edge of the outer leg 55 of the C-shaped channel. This shape provides greater reinforcement of the uprights 13, 16, without interfering with the sliding movement of the seat tab 70. Similarly to the uprights 13, 16, the struts 34, 37 can also be formed as a generally C-shaped channel, and also have strengthening transverse ribs 73 formed in the base of the channel.

The present chair can be molded polypropylene, polyethylene or polystyrene with or without mineral agents or other fillers. Prior art wooden chairs or metal folding chairs are much stronger than molded resin chairs. For example, wood is about ten times stronger than the polypropylene from which the folding chairs according to the invention are preferably made. As a result, it is important to have as much mass in the chair legs as possible, and to have a minimum of holes, slots, grooves, or other weakening perforations that are common in folding chairs made from metal or wood. The design of the uprights according to the invention has a simple generally C-shaped channel that runs uninterrupted from the top of the uprights to the bottom, with no right angles or other weak points.

Figure 5:
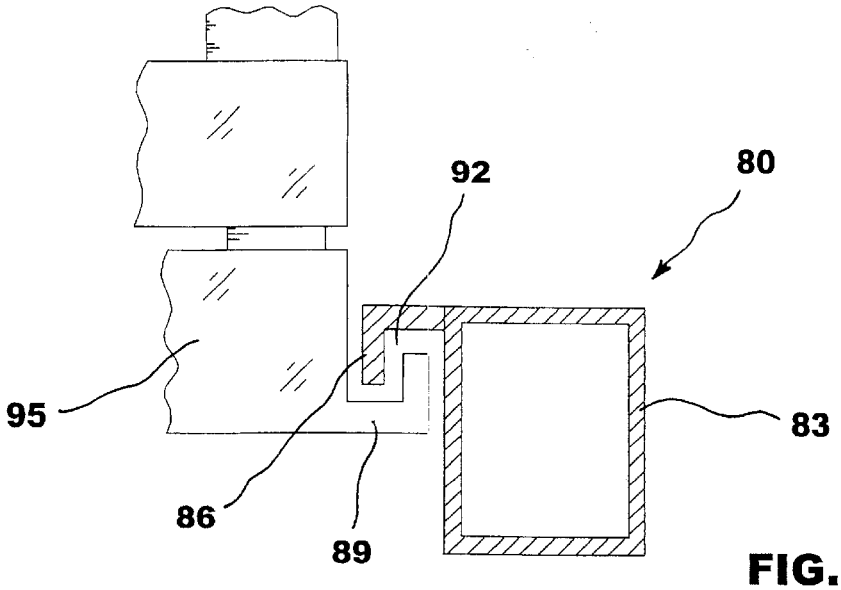
FIG. 5 ( PRIOR ART)
FIG. 5 is a cross section view similar to FIG. 3 except illustrating a prior art configuration.

In one known prior art type plastic folding chair, the upright 80 is a tubular member 83 with a third leg 86, forming a channel 92 adjacent the tube 83, as shown in FIG. 5. A tab 89, on either corner of the seat 95, is slidably engaged in the channel 92 formed by the third leg 86. One problem with this tubular upright 80 is that it can be very difficult to maintain, since pulling the core from the tubular upright 80 necessitates a male prong about two inches long, a significant maintenance problem. The C-shaped channel of the uprights 13, 16 made according to the invention provides a strong enough upright without using a tube. The present design utilizes an open channel for strength, but avoids problems inherent in molding hollow tubular parts. The present design is further strengthened by the addition of the transverse ribs 61 in the base of the C-shaped channel. The transverse ribs 61 can be short enough to allow for the tabs 70 on the seat 46 to ride in the C-shaped channel without the need for the third leg in the prior art upright 80. Thus, uprights 13, 16 formed from a single C-shaped channel avoid manufacturing problems associated with molding tubular members, such as maintenance of lengthy prongs needed to remove the core of the tubular member, and also reduces problems of warping and shrinkage.

As can be seen best in FIGS. 1 and 2, the uprights 13, 16 are also molded with a significant built-in curvature. The addition of curvature means there will be less drag on the part when it is injected. The reduction in drag is achieved because the curve in the uprights 13 and 16 uses less width in members 13 and 16. Less width can be used because the uprights are stronger when bent than when straight. Less drag means that the part doesn't bend or twist when it is ejected, which causes wear places where strength is vitally necessary. Curvature can also add strength to the part. In particular, the upper part 90 of the uprights 13, 16 can be formed at an angle to the lower part 93, with the apex 96 located generally at the point where the seat attaches. This can be done not only to provide a backrest 19 which is more perpendicular to the seat 46 when the folding chair 10 is unfolded for use, but also because the built-in curvature can reduce problems associated with shrinkage and warping. Commonly, the uprights of folding chairs are generally straight from top to bottom. Furthermore, according to a presently preferred embodiment of the invention, both the upper 90 and lower 93 portions of the uprights 13, 16 can individually have molded-in curvature. The upper portion can also be tapered from the apex 96, i.e., approximately where the seat tabs 70 engage the uprights 13, 16, to the top most portion where the backrest 19 is located. Since the most strength is needed where the seat 46 engages the uprights 13, 16, this taper permits a reduction the amount of material needed to mold the chair 10, without sacrificing strength. The lower portion 93 of the uprights 13, 16 can be curved from the apex 96 to the to the bottom of the uprights 13, 16. The struts 34, 37 can also have molded-in curvature for the same reasons explained above.

As explained above, this curvature can be molded into the shape of the uprights 13, 16 and struts 34, 37 in order to minimize drag during injection, problems with warping and shrinkage, and to add strength. For example, it has been a problem with molding straight tubes or channels, that the some sides of the channel or tube can cool at a rate uneven with other sides, thus causing the channel or tube to warp. However, it has been discovered that if curvature is molded in, the result can be that the curved member will straighten out somewhat, but still be generally curved. This presents less problems than with parts which are desired to be straight but end up warped.

Figure 6:
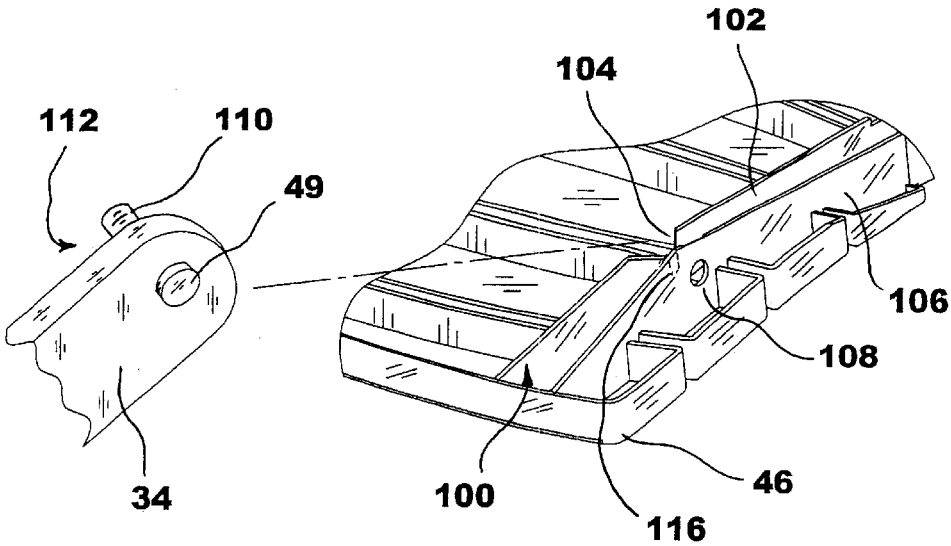
FIG. 6 is an exploded view, partially in section, illustrating the connection of the struts to the seat.

The top end 43 of each strut 34, 37 is rotatably attached to the underside of the seat 46, as shown best in FIG. 6. On the underside of the seat, at spaced apart locations at either side thereof, a raised channel formation 100 is provided for rotatably attaching the top end of each strut 34, 37. The raised channel formation 100 has an inner side 102 with a notched portion 104 and an outer side 106 with a hole 108 through which the pin 49 is disposed. The notched portion 104 receives the shank 110 of a second pin member 112 on the opposite side of the strut 34. The pin member 112 could have an enlarged head or cap on the distal end of the shank. But we prefer to have no cap. The shank 110 rotates freely in the lower part 116 of the notched portion 104, as does the pin 49 in the hole 108. The opposite end of each strut 34, 37 is configured to support the folding chair 10 on a generally flat surface in conjunction with the bottom of the uprights 13, 16.

Figure 7:
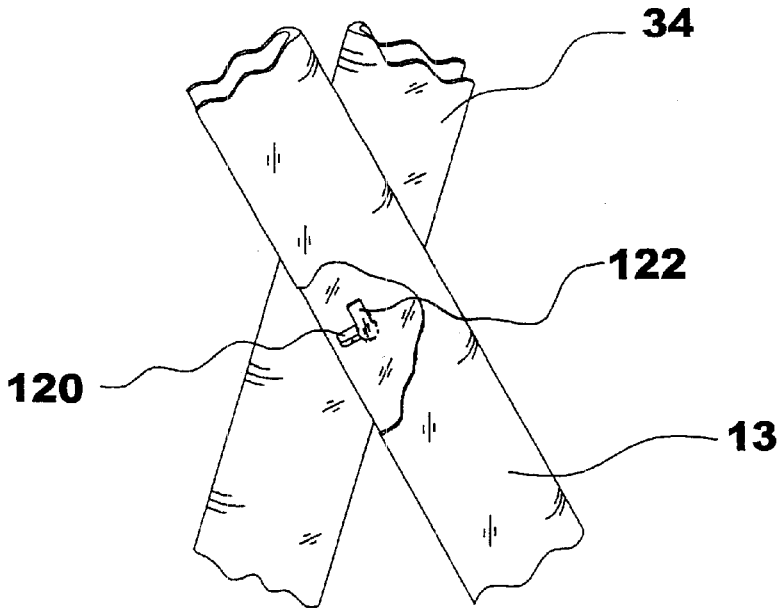
FIG. 7 is a perspective view, partially cut away, illustrating the attachment of the struts to the uprights.

The struts 34, 37 are also rotatably pinned to the uprights 13, 16 at approximately the midpoint of the struts 34, 37. In a preferred embodiment illustrated in FIG. 7, the lower portion of the uprights 13, 16 is also formed as a C-shaped channel. The inside wall of the channel has an opening 120, through which is inserted a correspondingly shaped pin or projection 122 formed on the outside wall of the strut members 34, 37. The projection 122 is first inserted through the correspondingly shaped opening 120 in the upright 13, and then rotated to lock the strut 34 adjacent the upright 13. The exact location at which the struts 34, 37 and uprights 13, 16 are pinned is determined in accordance with several considerations, including a desire for the chair 10 to sit generally level when unfolded and that it can be folded as flat as possible when not in use.

The chair can be configured such that the rear of the seat 46 is slidably engaged with the uprights 13, 16 wherein the chair 10 folds by sliding the rear of the seat 46 upwardly. Also, a protrusion 126, shown in FIG. 1, can be formed on the inner leg 58 of the C-shaped channel, of one or both uprights 13, 16, at the highest point of sliding travel of the seat tab 70 in the C-shaped channel, e.g., just below the backrest 19, when the chair 10 is folded. This protrusion 126 can help keep the seat tab 70 from inadvertently sliding back down the C-shaped channel after the chair 10 is folded. In a presently preferred embodiment, e.g., as shown in the drawing figures, the front of the seat 46 moves downwards during folding and the struts 34, 37 rotate forward into a nearly parallel position adjacent the uprights 13, 16. Alternatively, however, the chair 10 could be configured such that the rear of the seat 46 slides downwards and the front of the seat 46 moves upwards during folding.

Figure 8:
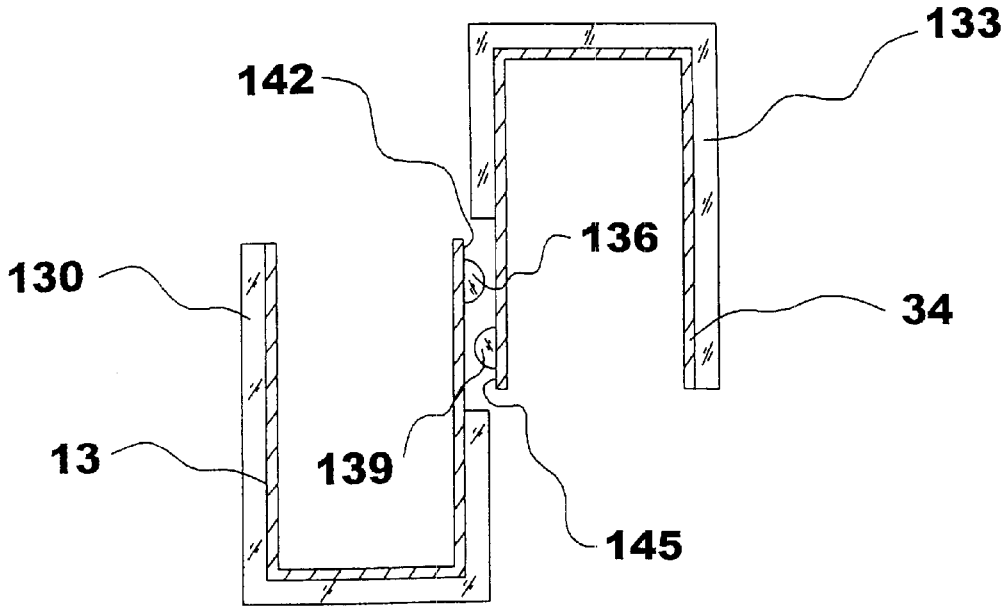
FIG. 8 is a view taken through line VIII—VIII in FIG. 2.

Additional features can include configuring the rear portion of the seat 46 with a downwardly depending "dip" 99 such that when the seat folds 46 against the uprights 13, 16, the rear of the seat 46 folds snugly against the backrest 19, permitting the chair 10 to fold more flat, making storage easier. Also, the cut-out portion 31 of the backrest 19 conveniently provides clearance for a person's hand when raising the back of the seat 46 up to fold the chair 10. A further feature is that the bottoms of each of the uprights 13, 16 and struts 34, 37 can have outwardly depending flanges 130, 133 which help support the chair 10 in a more stable fashion and prevent the bottoms of the uprights 13, 16 and struts 34, 37 from sinking into soft ground. Moreover, referring particularly to FIG. 8, in order to facilitate keeping the chair 10 in a closed position once folded, a portion of the sides 142, 145 of the bottoms of the uprights 13, 16 and struts 34, 37 which are adjacent each other, and overlap each other in the folded position, can be left without flanges. Instead, a projection 136, 139 is provided on each of the otherwise generally flat adjacent/overlapping surfaces 142, 145. The projections 136, 139 can be aligned, but offset such that the projections 136, 139 initially collide when the chair 10 is folded and the surfaces 142, 145 overlap. But, due to a degree of deformability of the overlapping molded plastic, surfaces 142, 145 will slide past each other when the chair 10 is forced closed. However, the projections 136, 139 are offset only slightly such that they remain in abutment with each other when the chair 10 is fully closed thus keeping the surfaces 142, 145 in an overlapped relationship. In this manner the chair 10 cannot be unfolded without applying enough force to again displace the projections 136, 139 back past each other, thus inhibiting the chair 10 from inadvertently unfolding.

The uprights 13, 16, cross piece 22, 25, 28, and the backrest 19, are preferably molded as a single piece, as are the struts 34, 37 and associated cross pieces 40. Each of the uprights 13, 16 and the struts 34, 37 preferably have a molded-in C-shaped channel. Specifically in regard to the uprights, the C-shaped channel has an outer leg 55 longer than the inner leg 58, at least in the region along the uprights 13, 16 wherein the seat tabs 70 are engaged in the C-shaped channel for sliding movement therein. The seat 46 with tabs 70 on either side thereof can also be molded as a single part. The folding chair 10 is preferably designed such that, in a folded position as shown in FIG. 2, the chair will stand alone on the outer edges of the ends of the uprights 13 ands 16. Furthermore, the legs and seat are designed to distribute the weight and position the center of gravity of the chair so that the chair is stable when standing in the upright position. This makes storage more convenient by reducing problems common with prior art folding chairs falling over, or having to be leaned up against something and then sliding down if not positioned just right. This feature also makes it easy to package these chairs in shipping cartons and display them at a retail store.

Although certain embodiments of the invention have been described in detail, it will be appreciated by those skilled in the art that various modifications to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

We claim:

1. A molded resin folding chair comprising:

a. a pair of uprights generally parallel to and spaced apart from each other being connected by at least one cross piece forming a backrest;

b. at least a portion of each upright having a generally C-shaped channel, said C-shaped channel formed by two generally parallel sidewalls and a front wall therebetween such that said generally C-shaped channel is open, having no side opposite said front wall;

c. a seat having a rear portion and opposite sides of said rear portion, each of said opposite sides having a tab slidably engaged in said C-shaped channel of respective ones of said pair of uprights;

d. a pair of struts each having an upper end rotatably attached to said seat, each of said pair of struts further rotatably attached to a respective one of said uprights; and e. wherein said folding chair is folded from an open position to a folded position by lifting said rear portion of said seat upwardly causing a front portion to move downwards via said tabs sliding in said C-shaped channel, said struts rotating about said rotatable attachments to said seat and said uprights such that said pair of uprights and struts and said seat assume generally parallel positions.

2. The folding chair of claim 1 further comprising each of said uprights having an upper backrest and a lower leg portion molded at an angle to said backrest.

3. The folding chair of claim 2 further comprising said backrest tapering from a greater width at a junction of said backrest and leg portions to a narrower width at a top of said backrest.

4. The folding chair of claim 2 further comprising said leg portion having a curvature from a junction of said backrest and leg portions to a bottom of said leg portion.

5. The folding chair of claim 1 wherein the chair is made of a material selected from the group consisting of polypropylene, polyethylene, and polystyrene and any of these plastics containing at least one filler.

6. The folding chair of claim 1 further wherein each of said pair of uprights and said pair of struts having a lower end and comprising flanges attached to each of the lower ends.

7. The folding chair of claim 1 further comprising a backrest attached to the pair of uprights, the backrest having a front portion and a top extending away from the front portion and a plurality of gussets extending from the top to the front portion.

8. A molded resin folding chair comprising:

a. a pair of uprights generally parallel to and spaced apart from each other being connected by at least one cross piece forming a backrest;

b. at least a portion of each upright having a generally C-shaped channel;

c. a seat having a rear portion and opposite sides of said rear portion, each of said opposite sides having a tab slidably engaged in said C-shaped channel of respective ones of said pair of uprights;

d. a pair of struts each having an upper end rotatably attached to said seat, each of said pair of struts further rotatably attached to a respective one of said uprights;

e. wherein said folding chair is folded from an open position to a folded position by lifting said rear portion of said seat upwardly causing a front portion to move downwards via said tabs sliding in said C-shaped channel, said struts rotating about said rotatable attachments to said seat and said uprights such that said pair of uprights and struts and said seat assume generally parallel positions; and f. transverse ribs at spaced apart locations within said C-shaped channel.

9. A molded resin folding chair comprising:

a. a pair of uprights generally parallel to and spaced apart from each other being connected by at least one cross piece forming a backrest;

b. at least a portion of each upright having a generally C-shaped channel;

c. a seat having a rear portion and opposite sides of said rear portion, each of said opposite sides having a tab slidably engaged in said C-shaped channel of respective ones of said pair of uprights;

d. a pair of struts each having an upper end rotatably attached to said seat, each of said pair of struts further rotatably attached to a respective one of said uprights;

e. wherein said folding chair is folded from an open position to a folded position by lifting said rear portion of said seat upwardly causing a front portion to move downwards via said tabs sliding in said C-shaped channel, said struts rotating about said rotatable attachments to said seat and said uprights such that said pair of uprights and struts and said seat assume generally parallel positions; and f. wherein said upper end of each of said pair of struts rotatably attached to said seat further comprises:

i. a pair of channel formations at spaced apart locations on an underside of said seat;

ii. a first side of each channel formation having a hole therethrough;

iii. a second side of each channel formation having a notched portion; and iv. said upper end of each of said pair of struts having opposing sides and a pin member projecting from each of said opposing sides, said pin member on each of said opposing sides being rotatably disposed in respective ones of said hole and said notched portion such that said upper end of each of said pair of struts is rotatably engaged in respective ones of said pair of channel formations on said underside of said seat.

10. A molded resin folding chair comprising:

a. a pair of uprights generally parallel to and spaced apart from each other being connected by at least one cross piece forming a backrest;

b. at least a portion of each upright having a generally C-shaped channel;

c. a seat having a rear portion and opposite sides of said rear portion, each of said opposite sides having a tab slidably engaged in said C-shaped channel of respective ones of said pair of uprights;

d. a pair of struts each having an upper end rotatably attached to said seat, each of said pair of struts further rotatably attached to a respective one of said uprights;

e. wherein said folding chair is folded from an open position to a folded position by lifting said rear portion of said seat upwardly causing a front portion to move downwards via said tabs sliding in said C-shaped channel, said struts rotating about said rotatable attachments to said seat and said uprights such that said pair of uprights and struts and said seat assume generally parallel positions;

f. wherein each of said pair of uprights and said pair of struts having a lower end and comprising flanges attached to each of the lower ends; and g. wherein:

i. adjacent sides of said lower ends of said uprights and struts having overlapping portions when said folding chair is in a folded position;

ii. said overlapping portions of said lower ends having no flanges, said overlapping portions having projections from said adjacent sides, said projections on respective adjacent sides of said uprights and struts being aligned with each other such that said projections must be forced over each other to achieve said folded position of said folding chair; and iii. said projections further being offset from each other such that once forced over each other, said folding chair is held in said folded position by abutment of said projections and said open position can be achieved only by forcing said projections back over each other.

11. A molded resin folding chair comprising:

a. a pair of uprights generally parallel to and spaced apart from each other being connected by at least one cross piece forming a backrest;

b. at least a portion of each upright having a generally C-shaped channel;

c. a seat having a rear portion and opposite sides of said rear portion, each of said opposite sides having a tab slidably engaged in said C-shaped channel of respective ones of said pair of uprights;

d. a pair of struts each having an upper end rotatably attached to said seat, each of said pair of struts further rotatably attached to a respective one of said uprights;

e. wherein said folding chair is folded from an open position to a folded position by lifting said rear portion of said seat upwardly causing a front portion to move downwards via said tabs sliding in said C-shaped channel, said struts rotating about said rotatable attachments to said seat and said uprights such that said pair of uprights and struts and said seat assume generally parallel positions; and f. a protrusion formed on an inner leg of said C-shaped channel of at least one of said pair of uprights, said protrusion located on said at least one upright at a position just prior to full movement of said tab in said folded position of said chair, said protrusion inhibiting said tab from sliding back down said C-shaped channel after said folding chair has been moved to said folded position.

* * * * *